US005869143A

United States Patent [19]

Becker et al.

[11] Patent Number: 5,869,143

[45] Date of Patent: Feb. 9, 1999

[54] METHOD AND DEVICE FOR COATING WEBS OF MATERIAL, PARTICULARLY PAPER OR CARDBOARD WEBS

[75] Inventors: Ingo Becker, Düsseldorf; Reinhard Knop, Essen, both of Germany

[73] Assignee: Jagenberg Papiertechnik GMBH, Neuss, Germany

[21] Appl. No.: 765,514

[22] PCT Filed: Jun. 24, 1995

[86] PCT No.: PCT/EP95/02464

§ 371 Date: Dec. 30, 1996

§ 102(e) Date: Dec. 30, 1996

[87] PCT Pub. No.: WO96/06226

PCT Pub. Date: Feb. 29, 1996

[30] Foreign Application Priority Data

Aug. 24, 1994 [DE] Germany ..... 44 29 968.8

[51] Int. Cl.[6] ..... B05D 3/12; B05C 11/02

[52] U.S. Cl. ..... 427/358; 427/356; 427/428; 118/106; 118/108; 118/123; 118/207; 118/244

[58] Field of Search ..... 427/358, 356, 427/428; 118/106, 108, 123, 207, 244

[56] References Cited

U.S. PATENT DOCUMENTS

| | | | |
|---|---|---|---|
| 3,722,465 | 3/1973 | Krautzberger | 118/123 |
| 4,537,801 | 8/1985 | Takeda | 427/358 |
| 4,738,877 | 4/1988 | Krautzberger | 427/356 |
| 5,028,450 | 7/1991 | Naka et al. | 427/9 |
| 5,348,768 | 9/1994 | Shibata et al. | 427/358 |
| 5,397,600 | 3/1995 | Shibata et al. | 427/358 |
| 5,569,494 | 10/1996 | Suzuki et al. | 427/358 |

FOREIGN PATENT DOCUMENTS

| | | |
|---|---|---|
| 1 030 168 | 5/1958 | Germany . |
| 2 419 006 | 11/1974 | Germany . |
| 34 23 251 A1 | 1/1985 | Germany . |
| 36 39 027 A1 | 5/1987 | Germany . |
| 36 33 833 C1 | 12/1987 | Germany . |
| 39 07 846 A1 | 9/1989 | Germany . |
| 40 14 463 A1 | 11/1991 | Germany . |
| 40 22 577 A1 | 1/1992 | Germany . |
| 43 38 776 A1 | 5/1994 | Germany . |
| WO 91/17309 | 11/1991 | WIPO . |
| 94/15021 | 7/1994 | WIPO . |

OTHER PUBLICATIONS

JP 1–231969 Japanese Patent Abstract C–665, 13 Dec. 1989, vol. 13, No. 562.

*Primary Examiner*—Janyce Bell
*Attorney, Agent, or Firm*—Herbert Dubno

[57] ABSTRACT

A process for coating a web of material includes the steps of displacing the web along a path in a travel direction, applying a coating material at an application located along the path to forming a curved segment of the web, and wiping off the excess of the coating material.

11 Claims, 4 Drawing Sheets

METHOD AND DEVICE FOR COATING WEBS OF MATERIAL, PARTICULARLY PAPER OR CARDBOARD WEBS

CROSS REFERENCE TO RELATED APPLICATIONS

This application is a national phase application of PCT/EP95/02464 filed Jun. 24, 1995 and based, in turn, on German national application P4429964.8 filed Aug. 24, 1994 under the International Convention.

TECHNICAL FIELD

FIELD OF THE INVENTION

There are known processes and devices for the coating of paper or cardboard webs, which are based on the principle that at first an excess of coating material is applied to the web by means of a coating system and then the excess is wiped off by means of a doctor element, until the desired coating weight is reached.

BACKGROUND OF THE INVENTION

State of the Art

The coating systems for excessive application can use applicator rollers (DE C 36 23 402) and applicator chambers which are open towards the web (EP-C 0 051 698). The doctor elements are usually mechanical doctor elements, such as scraping blades (DE-C 36 23 402), wiper rods (DE-C 30 22 955), wiper bars (EP-C 0 109 520) and so-called air knives, which wipe off the excess with compressed air coming from a slotted nozzle (DE-A 40 14 463). In order to achieve higher production speeds, i.e. higher speeds of the web of material, in these known processes the web of material is guided around a backing roller while the coating material is applied in excess and while the excess is wiped off, and is therefore supported by the roller over its entire width during the coating process.

Practice has proven that with the coating using the known application and doctoring systems, it is very difficult to obtain an end product with an even, and therefore high-quality coating, when working with very high production speeds of over 1000 m/min. At high web speeds, irregularities occur in the finished coating, such as variations in the coating weight, stripes or streaks.

OBJECTS OF THE INVENTION

It is the object of the invention to provide an improved generic process and a generic device so that at very high web speeds a coating with an even finish can be achieved.

SUMMARY OF THE INVENTION

This object can be achieved based on the concept that errors in the finished coating after the excess is wiped off can be traced back to irregularities of the excess film, which have not been evened out during doctoring. Particularly in cases of coating at high web speeds, considerable centrifugal forces directed away from the web act upon the coating material, due to the convex web guidance, i.e. a web guidance which is curved towards the uncoated side, during the application and the removal of the excess material. The centrifugal forces cause the coating material to spray away and/or lead to the irregularities, e.g. to the formation of stress lines in the film of coating material reaching the doctoring device. According to the invention the web is concave, i.e. curved towards the coating side. This way the centrifugal forces act in the direction towards the web, so that not only are the above-mentioned negative effects avoided, but due to the centrifugal forces a uniformization of the film on the coating material is effected before dosage.

As a further advantage it can be mentioned that the negative effect exerted by the air incorporated in the coating material or entrained by the web is minimized. The air contained in the coating material or existing on the web can lead to errors in the finished coating, even to uncoated portions in the end product. The centrifugal forces directed towards the web push away the air from the web prior to dosage, so that it escapes, or at least accumulates on the side of the excess film facing away from the web. The complete coating of the web with coating material is insured even with air inclusion.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
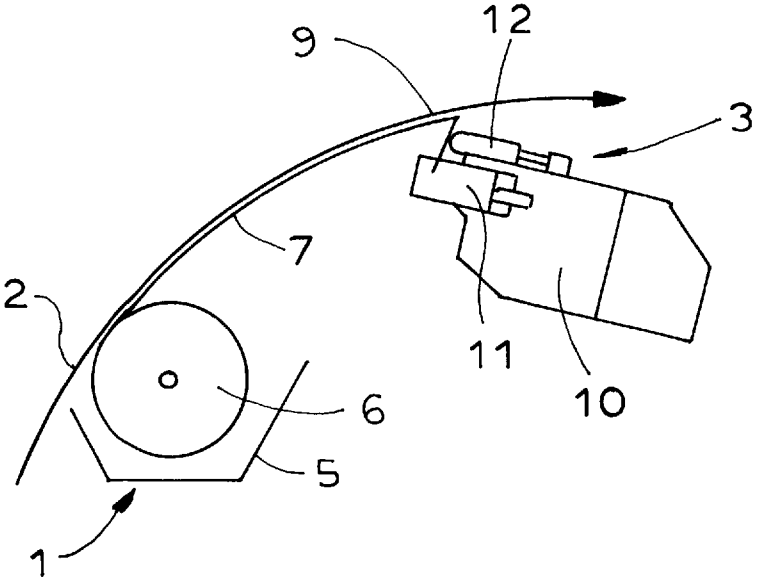
FIGS. 1, 2, 3, 4, 5, 6 and 7 show in principle the invention with various application and doctoring systems in diagrammatic form.

All coating device shown in the figures have an applicator 1 and a doctoring system 3 with a doctor element, arranged after downstream of the applicator in the travel direction of the paper or cardboard web 2. The applicator 1 applies an excess of a coating dye as coating material on the paper or cardboard web 2 and this is then wiped off by the doctor element of the doctoring system 3, until the desired coating weight is reached.

For the application of the coating dye known applicators are used. In the embodiments according to FIGS. 1, 2, 5, 6, 7 and 8 these are roller-type application systems with an applicator roller 6 drawing from a dye vat 4, which is driven in the same or in the opposite direction with the web and which applies the excess film 7 to the latter.

Figure 3:
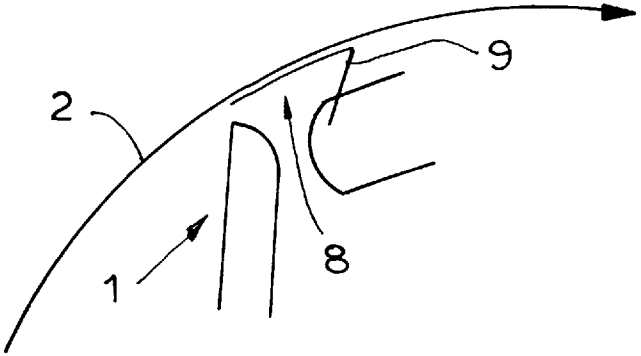

The embodiment according to FIG. 3 shows a so-called short-dwell coater with a nozzle chamber 8 open towards the web 2 supplied with coating dye with increased pressure. The application chamber 8 is closed at its outlet side by the doctor element, e.g. a scraping blade 9.

In order to wipe off the excess film 7 until the desired coating weight is reached, doctoring systems which are also known are used: In the embodiments according to FIGS. 1, 2, 4, 6, 7 and 8 the doctoring systems 3 comprise a scraping blade 9 as doctor element. The scraping blade 9 is fastened with its leg in a clamping girder 11 supported in a scraper bar 10, so that it can move back and forth with respect to web 2. On its rear side facing away from the web 2, the scraping blade 9 is reinforced by a support bar 12, which is adjustably mounted to the upper side of the scraper bar 10. The scraper bar 10 is suspended in a frame and is swingable about the doctoring line (=contact of the scraping blade point with the web 2). With this construction it is possible to adjust the contact pressure of the scraping blade 9 on the web 2, by displacing the leg of the scraping blade with the clamping girder 11, without modifying the angle between the scraping blade point and the web 2, set by swinging the scraper bar 10.

Figure 4:
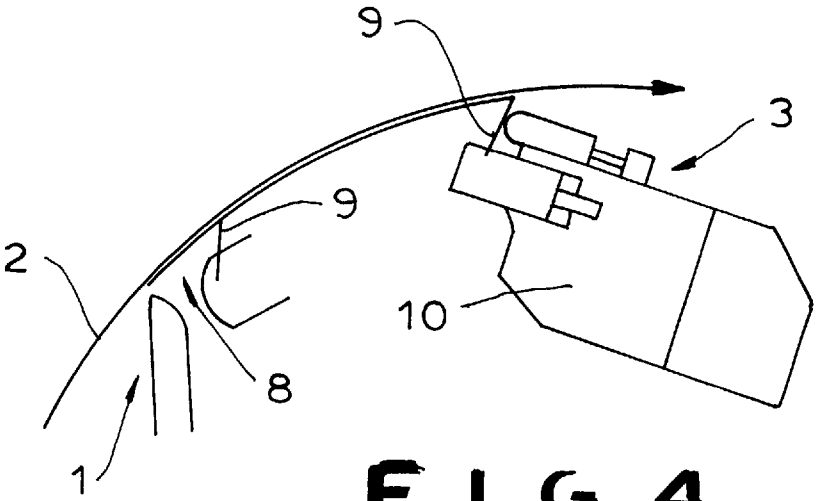

In the embodiment according to FIG. 4 a short-dwell application with a scraping blade 9 is used, in order to apply a predosed excess film 7 onto the web 2. The final doctoring is performed with a blade-doctoring system, which also has a scraping blade 9 as a final doctor element. The embodiment according to FIG. 5 comprises a roller-type application system 1 and a doctoring system 3 with an air knife as doctor element. The air knife consists of a slotted nozzle 13 extending over the width of web 2. A stream of compressed air is directed from the slotted nozzle 13, in order to wipe off the excess until the desired coating weight is reached.

Figure 1:
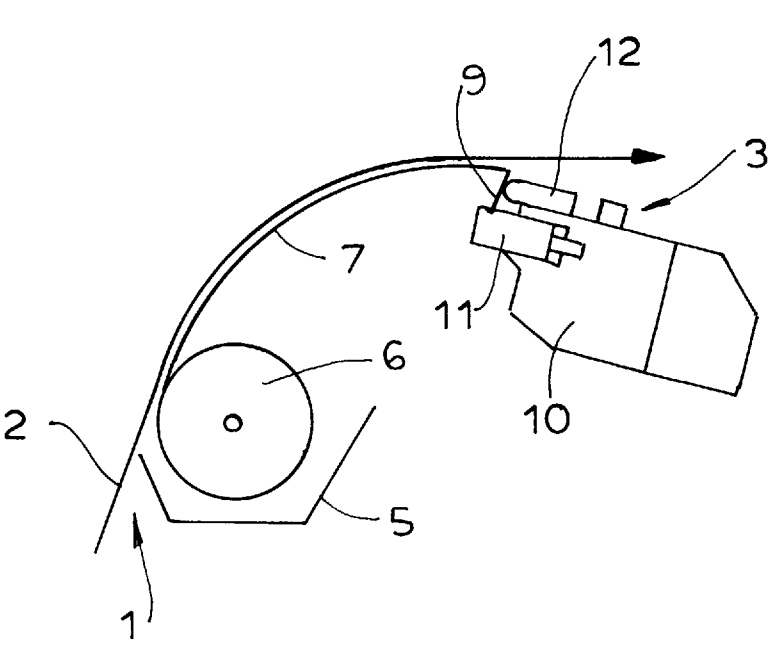
Figure 5:
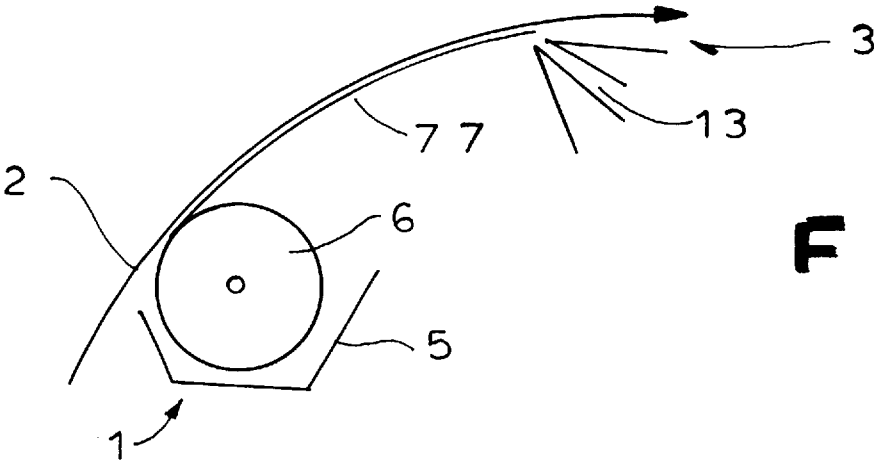

An essential feature of the invention is the course of the path travelled by the web 2 between the application of the excess film 7 and the dosing operation with the doctor element 9 or 13 to the desired coating weight. At least over one partial segment of the travel path between application and doctoring, the web 2 is guided so that it curves (=concavely) towards the coated side. On this concave path segment the web 2 is curved so that it travels along a concave path with its axis of curvature running parallel to the web 2 and transversely to the travel direction of the web on the coated side of the web at a certain distance therefrom. Advantageously the web 2 is guided curved concavely over the entire distance between the application and the doctoring (FIG. 1). When the web is concavely guided only over a segment of this distance—as shown in FIG. 2 —then it is preferably rectilinearly guided during the application of the excess and/or during doctoring. Immediately following the concave web guidance, the guidance of web 2 is rectilinear or only slightly convex, i.e. curved towards the uncoated side, so that the positive effects of the concave guidance are not cancelled or are only acceptably diminished. A slightly convex curvature can have the advantage of preventing the material scraped off by the doctor element from being sprayed against the web 2. Since the concavely curved path segment evens out the irregularities in the excess film 7, it is possible under certain circumstances to guide the web 2 in a convex manner before the concave guidance segment, e.g. during the application of excess film 7, without irregularities occurring in the finished coating, after doctoring.

Figure 6:
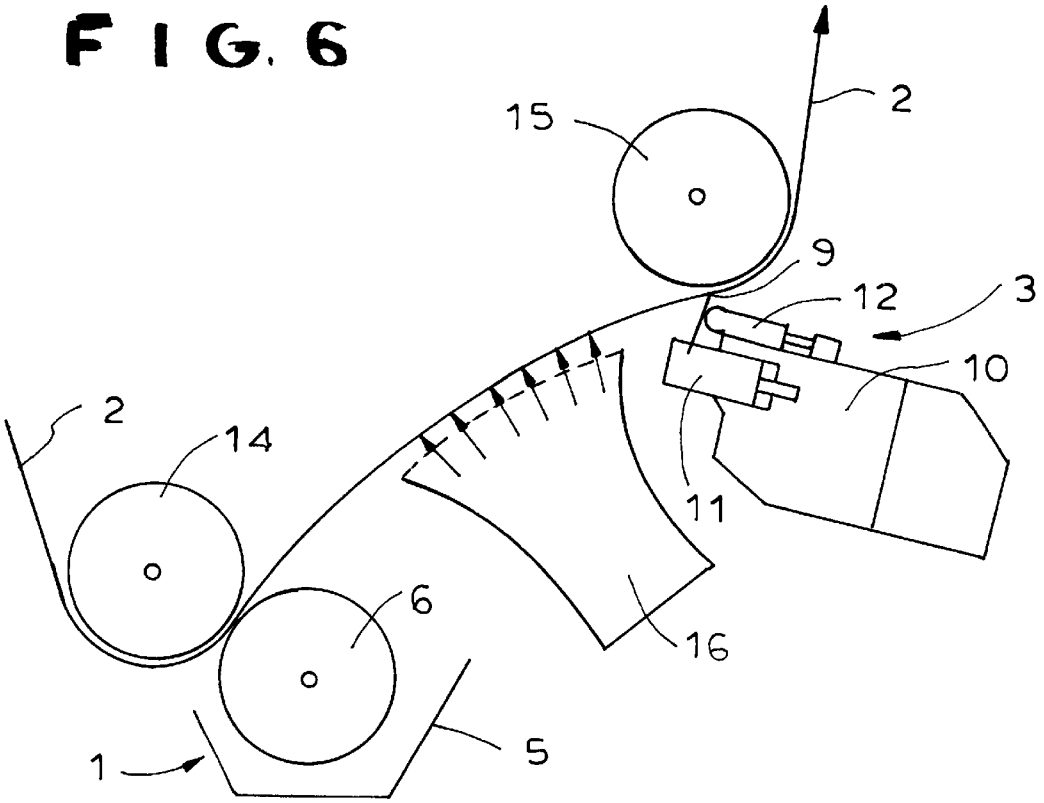
Figure 7:
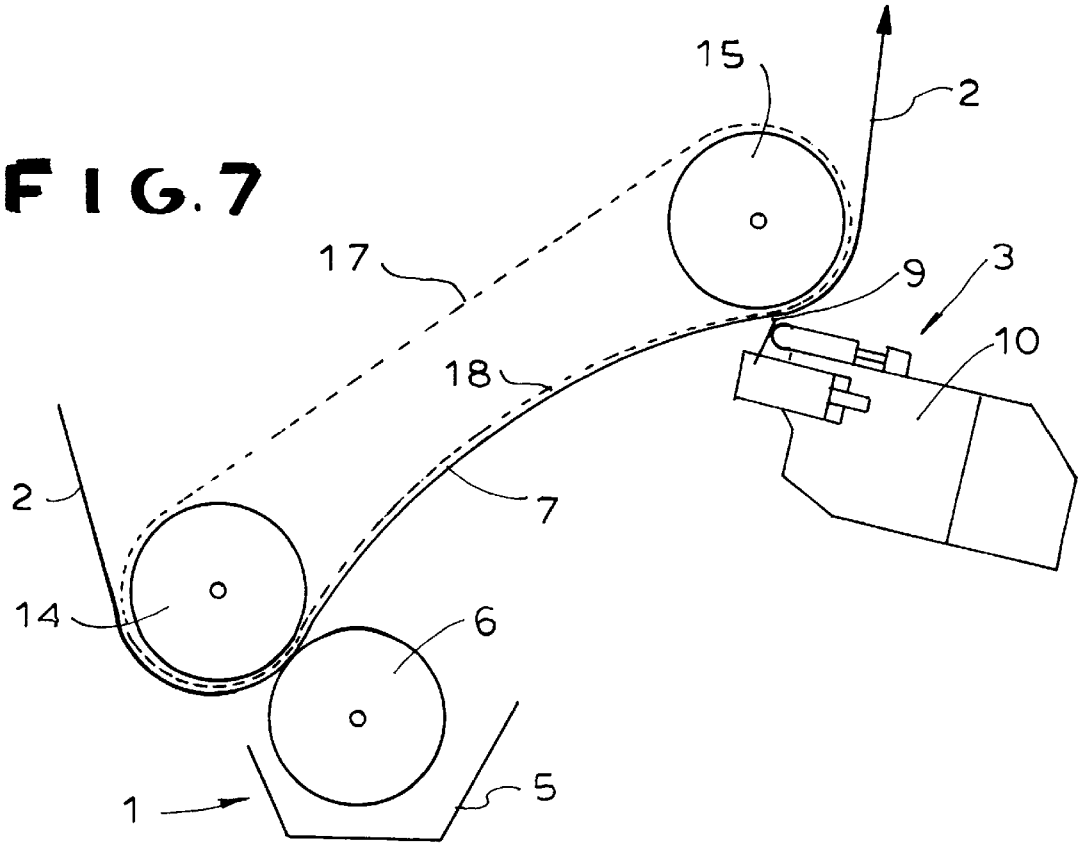

FIGS. 6 and 7 show two possibilities to realize the concave web guidance:

In the embodiment according to FIG. 6 the paper or cardboard web 2 is guided around two mutually parallel guide rollers 14, 15 arranged at a distance from each other. Between the applicator 1 and the doctoring system 3. The web 2 is concavely curved by means of an air jet nozzle 16. From the air jet nozzle 16 the compressed air is directed against the coated side of the web 2, whose web tension is set so that the desired curvature results. At the same time, the guide roller 15 on the outgoing side backs up the web 2 during doctoring against the contact pressure of the scraping blade 9. In addition to or instead of an overpressure on the coated side of the web, the curvature of the web 2 can also be performed with underpressure at the uncoated side.

FIG. 7 shows the principle of a preferred embodiment, wherein the coated and therefore sensitive web 2 is supported on the uncoated side during the concave guidance by a correspondingly curved guide surface, preferably by an endless support belt 17. The support belt 17, preferably made of an elastic material, is also guided by the two guide rollers 14, 15. One or both guide rollers 14, 15, preferably only guide roller 14 on the incoming side, are driven. Driving only the guide roller 14 on the incoming side has the advantage that the belt side 18 supporting the web 2 is less tensioned, and can be more easily concavely curved. The curving of the belt side 18 is caused by an underpressure between the two belt sides and/or by an overpressure exerted from the outside against the coated side, e.g. in the manner described in the embodiment according to FIG. 8. Instead of an endless support belt 17, it is also possible to use concavely curved mechanical guide surfaces, against which the web 2 is pressed, for instance with compressed air.

Figure 8:
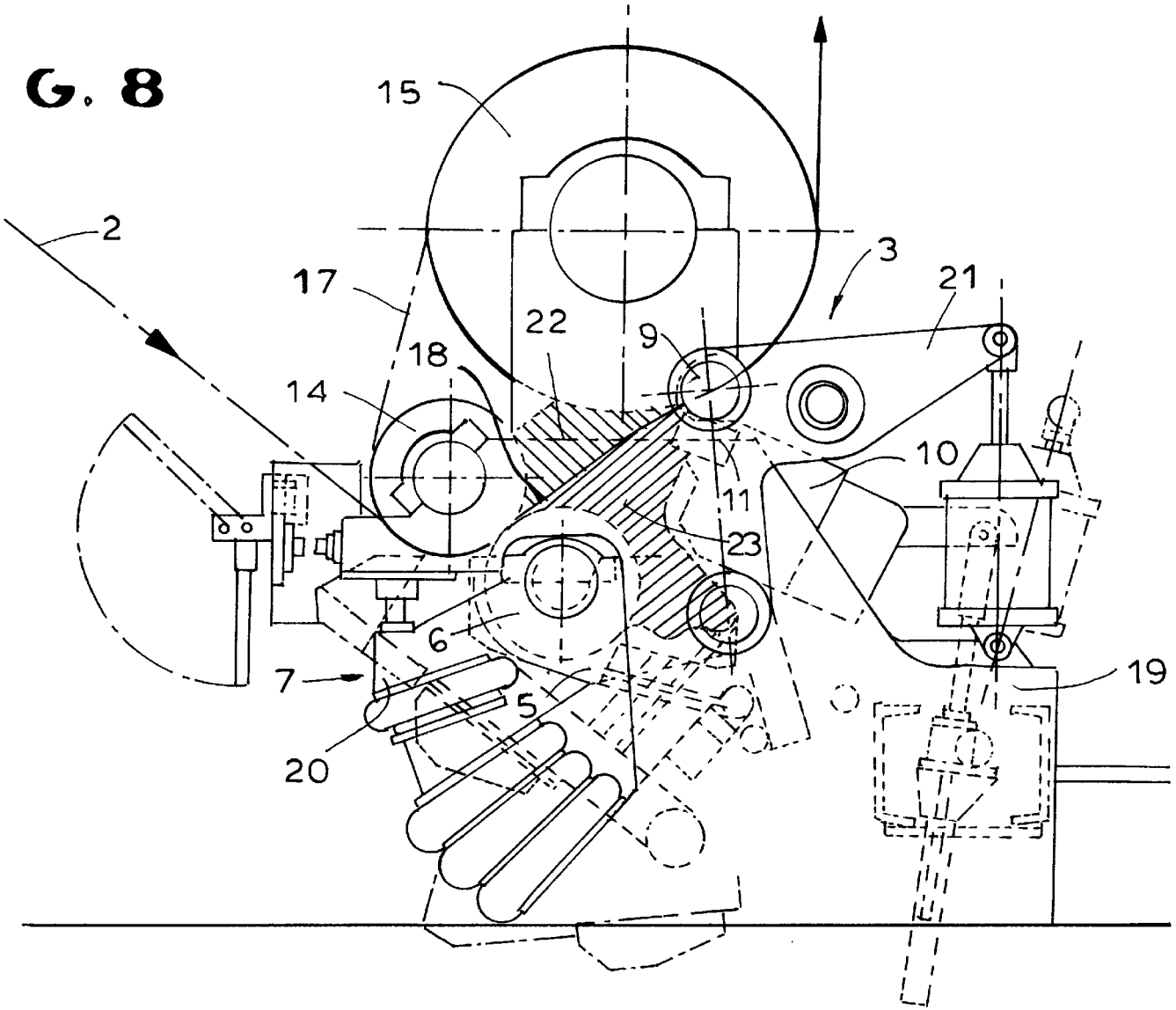
FIG. 8 is a side elevational view of a concrete embodiment.

The coating device shown in principle in FIG. 7 is shown in detail in FIG. 8.

On both longitudinal sides of web 2 the coating device has frame parts 19, wherein the two guide rollers 14, 15 built as support rollers, the applicator 1 and the doctoring system 3 are suspended. Around both support rollers 14, 15 runs the endless support belt 17 made of an elastic material, which extends over the entire work width. The support belt 17 is driven with the web speed of web 2 by the support roller 14, which for this purpose is connected with a drive not shown in the drawing. The applicator 1 comprises an application roller 6 which can be set against the support roller 14 in the area wrapped around by web 2. The application roller 6, which preferably runs concurrently with backing roller 14, i.e. in the opposite direction of rotation draws from a dye vat 5 and together with the latter is supported on a pivot lever so that it can move up and down.

The doctoring system 3 arranged in travel direction after and at a distance from the applicator, in the area of the support roller 15 is described in principle in the explanation of FIG. 1. The scraper bar 10 with the clamping girder 11 bearing the scraping blade 9 is suspended between two lateral parts 21, so that it can swing around the scraping blade point. The lateral parts 21 themselves are linked with the scraper bar so that they can be swung away, e.g. in order to accomplish the exchange of the scraping blade 9. The space 22 defined by the circumference of the support rollers 14, 15 and the free side 18 of the support belt 17 is sealed off and can be set at underpressure, in order to achieve the desired concave curving of the belt side 28 supporting the web 2. In order to insure that the web 2 rests safely against the belt side 18, this way following its curvature even at high speeds, the coated side of the web 2 can be acted upon by compressed air between the applicator roller 6 and the doctor element 9. For this purpose the space 23 between the applicator roller 6 and the doctor element (scraping blade 9) is sealed off with sealing elements, except for the side open towards the web 2, and connected to a source of compressed air. This way the web 2 is contactlessly pressed against the guide surface formed by belt side 18.

During coating, the web 2 is at first guided by the support roller 14 on the incoming side, whereby it rests outwardly on the support belt 17. Coating dye is applied in excess by the applicator roller 6 onto the web 2, which subsequently supported by the belt side 18 of the support belt 17 is guided concavely curved towards the second support roller 15. The scraping blade 9 is arranged in the area where the web 2 runs onto the support roller 15, so that the support roller 15 supports the web 2 against the pressure exerted by the scraping blade 9, before the web is convexly carried further by the support roller 15, to the extent that negative effects such as spraying of the dye, tension ringing occur.

We claim:

1. A process for coating a web of material comprising the steps of:

(a) displacing a web of material to be coated along a path in a travel direction;

(b) applying a coating material onto a coating side of the web at an application station located along the path;

(c) forming a concavely curved elongated continuous segment of said web having an upstream end immediately downstream from said application station and a downstream end spaced apart and downstream from the application station and being bridged with the upstream end by a curvature which has an axis spaced from said coating side and extending parallel to the web and transversely to said travel direction; and (d) wiping off the excess of the coating material at a doctoring station spaced apart and downstream from the application station and located along said downstream end of said curved segment.

2. The process defined in claim 1 wherein the step (c) further includes the step of generating excessive pressure along said segment on the coated side of the web of material to form said curvature.

3. The process defined in claim 2 wherein said step of generating pressure includes applying compressed air to press said web against said belt along said segment.

4. A process for coating a web of material comprising the steps of:

(a) displacing a web of material to be coated along a path in a travel direction;

(b) applying a coating material onto a coating side of the web at an application station located along the path;

(c) forming a concavely curved elongated segment of said web immediately downstream from said application station, said segment having an axis of curvature spaced from said coating side and extending parallel to the web and transversely to said travel direction;

(d) wiping off the excess of the coating material at a doctoring station spaced downstream from the application station and located along said curved segment; and (e) driving a continuous belt along a closed path between said doctoring and application stations, said web of material in step (c) being supported by the belt juxtaposed with an uncoated side of the web and having a curve complementary to the curvature of the web.

5. The process defined in claim 4 wherein the step (c) further includes a step of generating underpressure in a space formed between the stations and upper and lower stretches of the belt to form said curve on said belt.

6. A device for coating a web of material comprising:

means for running a web of material to be coated along a web path in a travel direction;

applicator means along said web path for applying a coating material to a coated side of the web;

doctoring means spaced downstream from said applicator means along said web path and including a scraping element for wiping off the excess of the coating material; and guide means for forming a segment of the web bridging said applicator and doctoring means along said web path and concavely curved toward the coated side, said curved segment of the web being formed with a concave curvature having an axis thereof, said axis being spaced from the coated side of the web and extending transversely to the travel direction and parallel to the web.

7. The device defined in claim 6, further comprising means for driving an endless support belt along a closed loop belt path between said application and doctoring means and having two elongated stretches, so that said belt supports an uncoated side of the segment of the web of material along one of the stretches between the applicator and doctoring means.

8. The device defined in claim 7, wherein said one stretch of the belt is formed with a curved guide surface supporting the uncoated side of the web along said segment.

9. The device defined in claim 8, further comprising means for generating underpressure on the uncoated side of the web.

10. The device defined in claim 8, further comprising pressure means for generating overpressure on the coated side of the web along said segment between the applicator and dosage means.

11. The device defined in claim 10, wherein said pressure means includes a source of compressed air blowing against the coated side of the segment of the web.

* * * * *